US010204549B1

(12) United States Patent
Byeon

(10) Patent No.: US 10,204,549 B1
(45) Date of Patent: Feb. 12, 2019

(54) ORGANIC LIGHT EMITTING DISPLAY DEVICE

(71) Applicant: LG Display Co., Ltd., Seoul (KR)

(72) Inventor: Boeon Byeon, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/819,931

(22) Filed: Nov. 21, 2017

(30) Foreign Application Priority Data

Aug. 11, 2017 (KR) ..... 10-2017-0102006

(51) Int. Cl.

| | |
|---|---|
| ***G09G 3/30*** | (2006.01) |
| ***G09G 3/3225*** | (2016.01) |
| ***G09G 3/3275*** | (2016.01) |
| ***G09G 3/3266*** | (2016.01) |

(52) U.S. Cl.
CPC ..... *G09G 3/3225* (2013.01); *G09G 3/3266* (2013.01); *G09G 3/3275* (2013.01); *G09G 2300/0426* (2013.01); *G09G 2310/08* (2013.01); *G09G 2320/0257* (2013.01); *G09G 2320/043* (2013.01); *G09G 2370/14* (2013.01)

(58) Field of Classification Search
CPC ..... G09G 3/30–3/3291; G09G 3/12
See application file for complete search history.

(56) References Cited

U.S. PATENT DOCUMENTS

2010/0123649 A1* 5/2010 Hamer ..... G09G 3/3225 345/76
2014/0168039 A1* 6/2014 Kim ..... G09G 3/3208 345/82
2014/0168191 A1* 6/2014 Byeon ..... G09G 3/3233 345/212
2014/0168192 A1* 6/2014 Jeong ..... G09G 3/3208 345/212
2015/0154908 A1* 6/2015 Nam ..... G09G 3/3233 345/76
2016/0293109 A1* 10/2016 Yang ..... G09G 3/3233

* cited by examiner

*Primary Examiner* — Sanghyuk Park
(74) *Attorney, Agent, or Firm* — Seed Intellectual Property Law Group LLP

(57) ABSTRACT

An organic light emitting display device that mitigates a connection restriction between a timing controller and a memory is disclosed. The organic light emitting display device comprises a display panel on which organic light emitting diodes and driving transistors that drive the organic light emitting diodes are arranged; a data driver that generates sensing data based on respective threshold voltages of the driving transistors and respective degradation levels of the organic light emitting diodes; a timing controller that generates compensation data, which may be used to perform external compensation and blur compensation, based on the sensing data and outputs the compensation data; a bridge circuit that receives the compensation data from the timing controller; and a memory that receives the compensation data from the bridge circuit. The bridge circuit and the memory are packaged in a source printed circuit board. The bridge circuit receives a clock generated within the timing controller, a command input from an external host system, and the compensation data in a differential signal mode.

11 Claims, 6 Drawing Sheets

ORGANIC LIGHT EMITTING DISPLAY DEVICE

CROSS REFERENCE TO RELATED APPLICATIONS

This application claims the benefit of the Korean Patent Application No. 10-2017-0102006 filed on Aug. 11, 2017, which is hereby incorporated by reference for all purposes as if fully set forth herein.

BACKGROUND

Technical Field

The present disclosure relates to an organic light emitting display device.

Description of the Related Art

Many technologies in the field of display devices for displaying visual information as a video or picture image have been developed in the information age. Among the display devices, an organic light emitting display device displays a picture image by using an organic light emitting diode that generates light by means of recombination of electrons and holes. The organic light emitting display device has a fast response speed and at the same time may maximize low contrast in accordance with self-emission, whereby the organic light emitting display device has received attention as a next generation display.

The organic light emitting display device comprises a display panel, a gate driver, a data driver, and a timing controller. The display panel includes data lines, gate lines, and a plurality of pixels formed at crossing portions between the data lines and the gate lines and supplied with data voltages of the data lines when gate signals are supplied to the gate lines. The pixels emit light at a predetermined brightness in accordance with the data voltages.

The gate driver supplies gate signals to the gate lines. The data driver includes source drive integrated circuits (hereinafter, referred to as "IC") for supplying the data voltages to the data lines. Also, the data driver senses a voltage between a driving transistor and an organic light emitting diode or a current flowing in the organic light emitting diode within each pixel through sensing lines. The organic light emitting display device performs external compensation for compensating for a threshold voltage of the driving transistor and blur compensation for compensating for degradation of the organic light emitting diode by generating compensation data using the sensed information.

The timing controller controls operation timings of the gate driver and the data driver. Also, the timing controller is supplied with sensing data generated using the voltage or current value of the organic light emitting diode, which is sensed by the data driver.

Also, the organic light emitting display device has a memory. The memory is non-volatile, and stores compensation data. The timing controller reads and uses the compensation data stored in the memory to drive the display panel.

A signal is supplied between the timing controller and the memory in a single-ended signal mode. The single-ended signal mode is a transmission mode of a signal, which may be applied to a distance of 40 mm to 60 mm. According to the single-ended signal mode, a distance between the timing controller and the memory is 40 mm to 60 mm. In this case, the memory can be arranged on only a control printed circuit board in which the timing controller is arranged.

If the memory is arranged on the control printed circuit board, a reading work for reading compensation data for driving of the display panel from a server or the previous control printed circuit board and a writing work for writing the read compensation data in a new control printed circuit board should be performed during exchange of the control printed circuit board. Also, during exchange of the display panel, the compensation data of the previous display panel should be deleted from the control printed circuit board and compensation data of a new display panel should be written. In this way, if the memory is arranged on the control printed circuit board, it is not easy to individually exchange the display panel or the control printed circuit board.

BRIEF SUMMARY

Accordingly, the present disclosure is directed to an organic light emitting display device that substantially obviates one or more problems due to limitations and disadvantages of the related art.

An advantage of the present disclosure is to provide an organic light emitting display device that mitigates a connection restriction between a timing controller and a memory.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, an organic light emitting display device according to one embodiment of the present disclosure comprises a display panel on which organic light emitting diodes and driving transistors for driving the organic light emitting diodes are arranged; a data driver for generating sensing data by using a threshold voltage of the driving transistor and a degradation level of the organic light emitting diodes; a timing controller for generating compensation data, which may perform external compensation and blur compensation, by using the sensing data and outputting the compensation data; a bridge circuit for receiving the compensation data from the timing controller; and a memory for receiving the compensation data from the bridge circuit. The bridge circuit and the memory are packaged in a source printed circuit board. The bridge circuit receives a clock generated within the timing controller, a command input from an external host system, and the compensation data in a differential signal mode.

In another aspect of the present disclosure, an organic light emitting display device comprises a display panel on which organic light emitting diodes and driving transistors for driving the organic light emitting diodes are arranged; a data driver for generating sensing data by using a threshold voltage of the driving transistor and a degradation level of the organic light emitting diodes; a timing controller for generating compensation data, which may perform external compensation and blur compensation, by using the sensing data and outputting the compensation data; and a memory for receiving the compensation data from the timing controller. The memory is packaged in a source printed circuit board. The timing controller and the memory are connected with each other by a plurality of lines for bi-directionally transferring a clock generated within the timing controller, a command input from an external host system, and the compensation data in accordance with an LVDS mode of a differential signal mode. The timing controller and the memory include an input and output unit for inputting and outputting the clock, the command and the compensation data in the LVDS mode.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
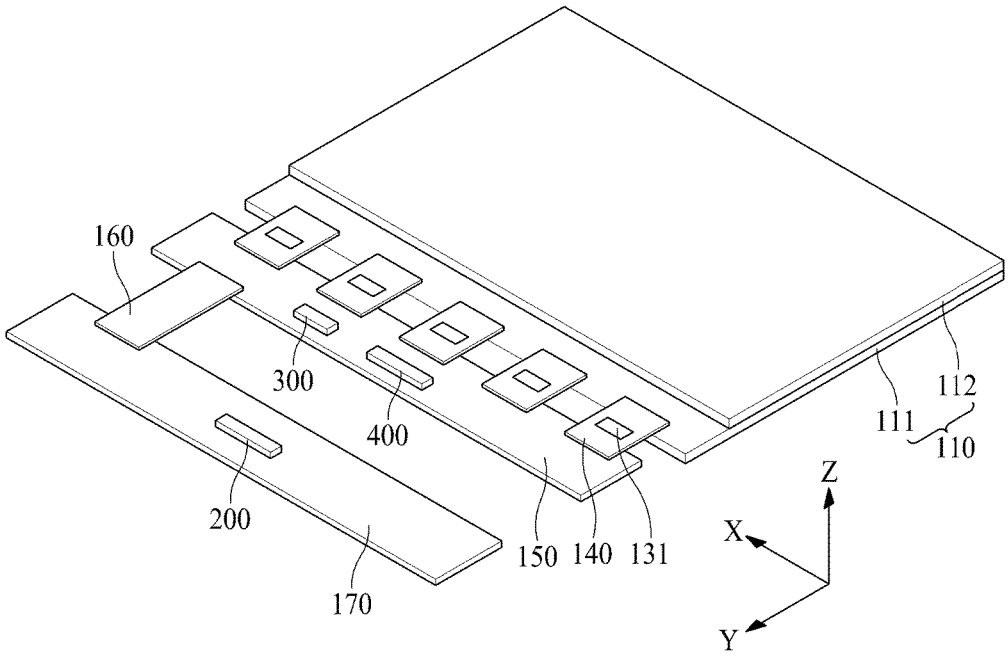
FIG. 1 is a perspective view illustrating an organic light emitting display device according to the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where "comprise", "have", and "include" described in the present specification are used, another part may be added unless "only~" is used. The terms of a singular form may include plural forms unless referred to the contrary.

In construing an element, the element is construed as including an error range although there is no explicit description.

In describing a position relationship, for example, when the position relationship is described as "upon~", "above~", "below~", and "next to~", one or more portions may be arranged between two other portions unless "just" or "direct" is used.

In describing a time relationship, for example, when the temporal order is described as "after~", "subsequent~", "next~", and "before~", a case which is not continuous may be included unless "just" or "direct" is used.

It will be understood that, although the terms "first", "second", etc., may be used herein to describe various elements, these elements should not be limited by these terms. These terms are only used to distinguish one element from another element. Therefore, a first element could be termed a second element, and, similarly, a second element could be termed a first element, without departing from the scope of the present disclosure.

"X-axis direction", "Y-axis direction" and "Z-axis direction" should not be construed by a geometric relation only of a mutual vertical relation, and may have broader directionality within the range that elements of the present disclosure may act functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, the preferred embodiment of the present disclosure will be described in detail with reference to the accompanying drawings.

Figure 2:
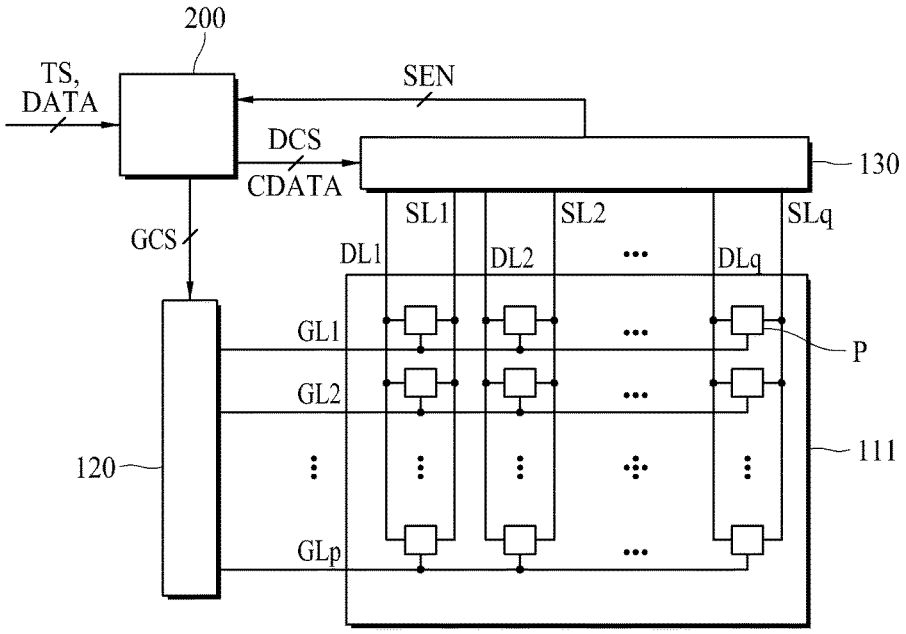
FIG. 2 is a block diagram illustrating an organic light emitting display device according to the present disclosure.
Figure 3:
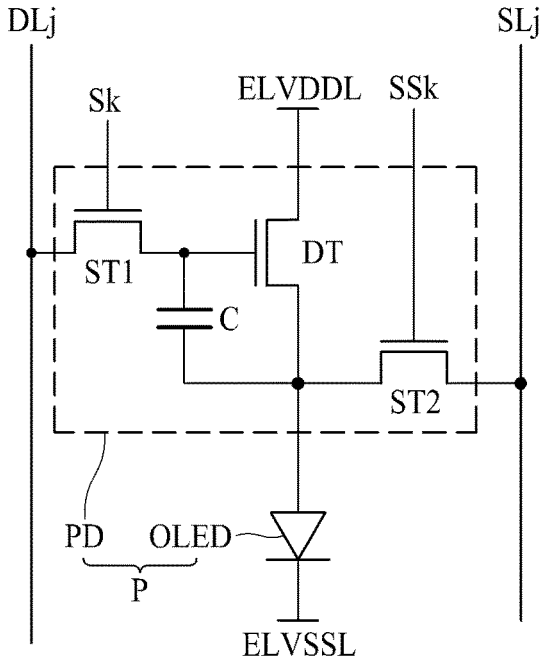
FIG. 3 is a circuit diagram illustrating a pixel of FIG. 2.

FIG. 1 is a perspective view illustrating an organic light emitting display device according to the present disclosure. FIG. 2 is a block diagram illustrating an organic light emitting display device according to the present disclosure. FIG. 3 is a circuit diagram illustrating a pixel of FIG. 2.

The organic light emitting display device according to the present disclosure comprises a display panel 110, a gate driver 120, a data driver 130, a flexible film 140, a source printed circuit board (S-PCB) 150, a connector 160, a control printed circuit board (C-PCB) 170, a timing controller (T-con) 200, a bridge circuit 300, and a memory 400.

The display panel 110 includes a lower substrate 111 and an upper substrate 112. The lower substrate 111 may be a thin film transistor substrate made of plastic or glass. The upper substrate 112 may be a second substrate 112. The second substrate 112 may be an encapsulation substrate made of a plastic film, glass substrate, or protective film.

The lower substrate 111 includes a display area and a non-display area provided near the display area. The display area is provided with pixels P to display an image. On the lower substrate 111, gate lines GL1 to GLp (p is a positive integer of 2 or more), data lines DL1 to DLq (q is a positive integer of 2 or more) and sensing lines SL1 to SLq are arranged. The data lines DL1 to DLq may be arranged in parallel with the sensing lines SL1 to SLq. The data lines DL1 to DLq and the sensing lines SL1 to SLq may be arranged to cross the gate lines GL1 to GLp.

Each of the pixels P includes an organic light emitting diode (OLED) and a pixel driving unit PD. In FIG. 3, for convenience of description, only a pixel P connected to the jth data line DLj (j is a positive integer that satisfies $1 \leq j \leq q$), the jth sensing line SLj, the kth scan line Sk (k is a positive integer that satisfies $1 \leq k \leq p$), and the kth sensing signal line SSk is shown. The kth scan line Sk and the kth sensing signal line SSk are included in the kth gate line GLk. That is, each gate line GL1 to GLp may include both a scan line and a sensing signal line, which are separate lines.

The organic light emitting diode OLED emits light in accordance with a current supplied through a driving transistor DT. An anode electrode of the organic light emitting diode OLED may be connected to a source electrode of the driving transistor DT, and its cathode electrode may be connected to a low potential voltage line ELVSSL to which a potential voltage ELVSS lower than a high potential voltage ELVDD is supplied.

The organic light emitting diode OLED may include an anode electrode, a hole transporting layer, an organic light emitting layer, an electron transporting layer, and a cathode electrode. In this case, if a voltage is applied to the anode electrode and the cathode electrode, holes and electrons are moved to the organic light emitting layer through the hole transporting layer and the electron transporting layer, respectively, and are combined with each other in the organic light emitting layer to emit light.

The pixel driving unit PD supplies a current to the organic light emitting diode OLED and the jth sensing line SLj. The pixel driving unit PD may include a driving transistor DT, a first transistor ST1 controlled by a scan signal of the scan line Sk, and a second transistor ST2 controlled by a sensing signal of the sensing signal line SSk, and a capacitor C.

The pixel driving unit PD is supplied with a data voltage VDATA of the data line DLj connected to the pixel P when the scan signal is supplied from the scan line Sk connected to the pixel in a display mode, and supplies a current of the driving transistor DT according to the data voltage VDATA to the organic light emitting diode OLED. The pixel driving unit PD flows the current of the driving transistor DT to the sensing line SLj connected to the pixel when the sensing signal is supplied from the sensing signal line SSk connected to the pixel P.

The driving transistor DT is provided between a high potential voltage line ELVDDL and the organic light emitting diode OLED. The driving transistor DT controls the current flowing from the high potential voltage line ELVDDL to the organic light emitting diode OLED in accordance with a voltage difference between a gate electrode and a source electrode. The gate electrode of the driving transistor DT may be connected to a first electrode of the first transistor ST1, the source electrode may be connected to the anode electrode of the organic light emitting diode OLED, and a drain electrode may be connected to the high potential voltage line ELVDDL to which the high potential voltage ELVDD is supplied.

The first transistor ST1 is turned on by the kth scan signal of the kth scan line Sk, and supplies a voltage of the jth data line DLj to the gate electrode of the driving transistor DT. The gate electrode of the first transistor ST1 may be connected to the kth scan line Sk, its first electrode may be connected to the gate electrode of the driving transistor DT, and its second electrode may be connected to the jth data line DLj. The first transistor ST1 may be referred to as a scan transistor.

The second transistor ST2 is turned on by the kth sensing signal of the kth sensing signal line SSk, and connects the jth sensing line SLj to the source electrode of the driving transistor DT. A gate electrode of the second transistor ST2 may be connected to the kth sensing signal line SSk, and its first electrode may be connected to the jth sensing line SLj, and its second electrode may be connected to the source electrode of the driving transistor DT. The second transistor ST2 may be referred to as a sensing transistor.

The capacitor C is provided between the gate electrode and the source electrode of the driving transistor DT. The capacitor C stores a differential voltage between gate and source voltages of the driving transistor DT.

It has been described in FIG. 2 that the driving transistor DT and the first and second transistors ST1 and ST2 are formed in, but not limited to, an N type MOSFET (Metal Oxide Semiconductor Field Effect Transistor). The driving transistor DT and the first and second transistors ST1 and ST2 may be formed in a P type MOSFET. Also, the first electrode may be, but not limited to, a source electrode, and the second electrode may be, but not limited to, a drain electrode. That is, the first electrode may be a drain electrode, and the second electrode may be a source electrode.

In the display mode, the data voltage VDATA of the jth data line DLj is supplied to the gate electrode of the driving transistor DT when a scan signal is supplied to the kth scan line Sk, and an initialization voltage of the jth sensing line SLj is supplied to the source electrode of the driving transistor DT when a sensing signal is supplied to the kth sensing signal line SSk. For this reason, in the display mode, the current of the driving transistor DT, which flows in accordance with a voltage difference between the voltage of the gate electrode and the voltage of the source electrode of the driving transistor DT, is supplied to the organic light emitting diode OLED, and the organic light emitting diode OLED emits light in accordance with the current of the driving transistor DT. At this time, since the data voltage VDATA is a voltage obtained by compensating for electron mobility and a threshold voltage of the driving transistor DT, the current of the driving transistor DT does not depend on the electron mobility and threshold voltage of the driving transistor DT.

In a sensing mode, a sensing voltage of the jth data line is supplied to the gate electrode of the driving transistor DT when a scan signal is supplied to the kth scan line Sk, and an initialization voltage of the jth sensing line SLj is supplied to the source electrode of the driving transistor DT when a sensing signal is supplied to the kth sensing signal line SSk. Also, the second transistor ST2 is turned on when the sensing signal is supplied to the kth sensing signal line SSK, whereby the current of the driving transistor DT, which flows in accordance with a voltage difference between the voltage of the gate electrode and the voltage of the source electrode of the driving transistor DT, flows to the jth sensing line SLj.

The gate driver 120 receives a gate driver control signal GCS from the timing controller 200. The gate driver 120 supplies gate signals to the gate lines GL1 to GLp in accordance with the gate driver control signal GCS. The gate signals include scan signals and sensing signals. The gate driver 120 may be formed on the non-display area outside one side or both sides of the display area of the display panel 110 in a gate driver in panel (GIP) mode.

The data driver 130 receives compensation digital video data CDATA and a data driver control signal DCS from the timing controller 200. The compensation digital video data CDATA are digital video data corrected by performing external compensation, which compensates for a threshold voltage of the driving transistor DT, and blur compensation, which compensates for a degradation level of the organic light emitting diode OLED, for the digital video data DATA. The data driver 130 converts the compensation digital video data CDATA to an analog data voltage in accordance with the data driver control signal DCS and supplies the analog data voltage to the data lines DL1 to DLq. The pixels P to which data voltages will be supplied are selected by the scan signals supplied from the gate driver 120. The selected pixels P are supplied with the data voltages and emit light at a predetermined brightness.

The data driver 130 is supplied with a sensing voltage or sensing current from the sensing lines SL1 to SLq. The data driver 130 generates sensing data SEN, which include information on a degradation level of the organic light emitting diode OLED and a threshold voltage of the driving transistor DT of each pixel P, by using the sensing voltage or sensing current. The data driver 130 supplies the sensing data SEN to the timing controller 200.

The data driver 130 includes a plurality of source driver integrated circuits (SDICs) 131. Each of the source driver ICs 131 is packaged in each of the flexible films 140. Each of the flexible films 140 may be attached onto pads provided on the lower substrate 111 in a tape automated bonding (TAB) manner by using an anisotropic conductive film (ACF). Since the pads are connected with the data lines DL1 to DLq, the source driver ICs 131 may be connected to the data lines DL1 to DLq.

Each of the flexible films 140 may be provided in a chip on film (COF) mode or chip on plastic (COP) mode. The chip on film may include a base film such as polyimide and a plurality of conductive lead lines provided on the base film. Each of the flexible films 140 may be bent or curved. Each of the flexible films 140 may be attached onto the lower substrate 111 of the display panel 110 and the source printed circuit board 150.

The source printed circuit board 150 may be attached to the flexible films 140. A bridge circuit 300 and a memory 400 may be packaged in the source printed circuit board 150. The source printed circuit board 150 may be a flexible printed circuit board. The source printed circuit board 150 is connected with the control printed circuit board 170 through the connector 160.

The connector 160 connects the source printed circuit board 150 with the control printed circuit board 170. The connector 160 may be realized as a cable or a connector having a plurality of pins.

A plurality of driving chips may be packaged in the control printed circuit board 170. The timing controller 200 may be packaged in the control printed circuit board 170. The control printed circuit board 170 is connected with the source printed circuit board 150 by the connector 160.

The timing controller 200 receives digital video data DATA and timing signals TS from an external host system. The external host system may be realized as a navigation system, a set-top box, a DVD player, a blu-ray player, a personal computer (PC), a home theater system, a broadcast receiver, a phone system, etc. The host system includes a system on chip (SOC) having a scaler built therein, and converts digital video data DATA of an input image to a format suitable to be displayed on the display panel 110.

The timing signals TS may include a vertical synchronization signal, a horizontal synchronization signal, a data enable signal, a dot clock, etc. The vertical synchronization signal is a signal that defines one frame period. The horizontal synchronization signal is a signal that defines one horizontal period required to supply data voltages to the pixels of one horizontal line. The data enable signal is a signal that defines an input period of valid data. The dot clock is a signal repeated at a predetermined short period.

To control operation timings of the gate driver 120 and the data driver 130, the timing controller 200 generates a gate driver control signal GCS for controlling an operation timing of the gate driver 120 and a data driver control signal DCS for controlling an operation timing of the data driver 130 on the basis of the timing signals TS. The timing controller 200 outputs the gate driver control signal GCS to the gate driver 120, and outputs the data driver control signal DCS to the data driver 130.

The timing controller 200 receives sensing data SEN from the data driver 130. The timing controller 200 generates compensation data, which may be used by the timing controller 200 to perform external compensation and blur compensation, by using the sensing data SEN. The timing controller 200 generates compensation digital video data CDATA by performing the external compensation and blur compensation using the compensation data. The timing controller 200 supplies the compensation digital video data CDATA, for which external compensation and blur compensation are performed, to the data driver 130. The timing controller 200 outputs the compensation data. The output compensation data are stored in the memory 400.

The bridge circuit 300 receives the compensation data from the timing controller 200. The memory 400 receives the compensation data from the bridge circuit 300. The bridge circuit 300 and the memory 400 may be packaged in the source printed circuit board 150.

Figure 4:
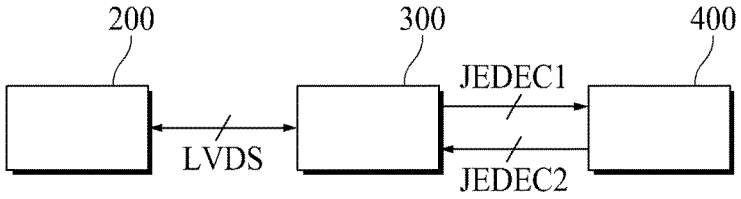
FIG. 4 is a block diagram illustrating a method for transmitting compensation data of an organic light emitting display device according to the present disclosure.
Figure 5:
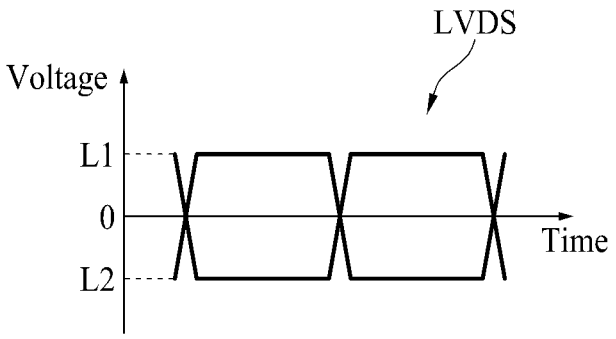
FIG. 5 is a waveform diagram illustrating a differential signal mode according to the present disclosure.
Figure 6:
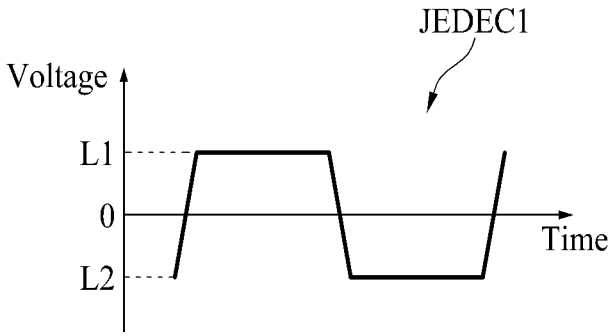
FIG. 6 is a waveform diagram illustrating a single-ended signal mode according to the present disclosure.

FIG. 4 is a block diagram illustrating a method for transmitting compensation data of an organic light emitting display device according to the present disclosure. FIG. 5 is a waveform diagram illustrating a differential signal mode (LVDS) according to the present disclosure. FIG. 6 is a waveform diagram illustrating a single-ended signal mode (JEDEC1) according to the present disclosure.

The organic light emitting display device according to the present disclosure supplies the compensation data generated by the timing controller 200 to the bridge circuit 300 in a differential signal mode. An example of the differential signal mode is a low voltage differential signal (LVDS) mode.

In the differential signal mode (LVDS), two input voltage are input at the same time. The differential signal mode is an interface for transferring information in accordance with a voltage difference between two input voltages. In the differential signal mode (LVDS), any one input voltage has a first logic level L1 at a random time, and the other input voltage has a second logic level L2. If the differential signal mode (LVDS) is used, a transmitter for outputting a signal and a receiver for receiving a signal are connected with each other through at least two lines.

The timing controller 200 supplies a clock generated therein and a command input by the external host system to the bridge circuit 300 in a differential signal mode. The clock may be a dot clock supplied from the external host system, or may be a Voltage-controlled oscillator (VCO) clock generated inside the timing controller separately from the dot clock. The command includes a command for updating compensation data in the memory 400 by means of a clock per certain time and a command for storing compensation data in the memory 40 by means of the need of the external host system.

The bridge circuit 300 may supply a response signal and the compensation data stored in the memory 400 to the timing controller 200. If the differential signal mode (LVDS) is used, the transmitter and the receiver have the same input and output structure. Therefore, if the differential signal mode (LVDS) is used, bidirectional communication between the timing controller 200 and the bridge circuit 300 may be performed.

If the differential signal mode (LVDS) is used to transmit and receive a signal, it is less affected by external noise than signal transmission based on the first and second single-ended signal modes JEDEC1 and JEDEC2. The differential signal mode (LVDS) facilitates signal transmission of a long distance. If the differential signal mode (LVDS) is used, a length of a connection line or cable from the transmitter to the receiver may be increased to 1 m to 10 m. This length is increased more remarkably than 40 mm to 60 mm corresponding to a case that the first and second signal ended signal modes JEDEC1 and JEDEC2 are used.

If the differential signal mode (LVDS) is applied between the timing controller 200 and the bridge circuit 300, a problem caused by noise between the timing controller 200 and the bridge circuit 300 may be avoided. Also, if the differential signal mode (LVDS) is applied between the timing controller 200 and the bridge circuit 300, the signal transmission distance between the timing controller 200 and the bridge circuit 300 may be increased. Therefore, the timing controller 200 and the bridge circuit 300 may be arranged more freely.

The bridge circuit 300 supplies clock, command and compensation data to the memory 400 in the first single-ended signal mode JEDEC1. The memory 400 supplies the response signal and the compensation data stored therein to the bridge circuit 300 in the second single-ended signal mode JEDEC2.

The first and second single-ended signal modes JEDEC1 and JEDEC2 are unidirectional communication methods that may transmit a signal in only one direction. Each of the first and second single-ended signal modes JEDEC1 and JEDEC2 may be realized in one line. One of the first and second single-ended signal modes JEDEC1 and JEDEC2 is a JEDEC mode defined by the Joint Electron Device Engineering Council of the USA.

Most of the memories 400 are designed and mass-produced in accordance with the JEDEC mode. Therefore, if an interface for supplying and receiving a signal between the bridge circuit 300 and the memory 400 depends on the single-ended signal mode, the interface may easily be applied to the plurality of memories 400.

Figure 7:
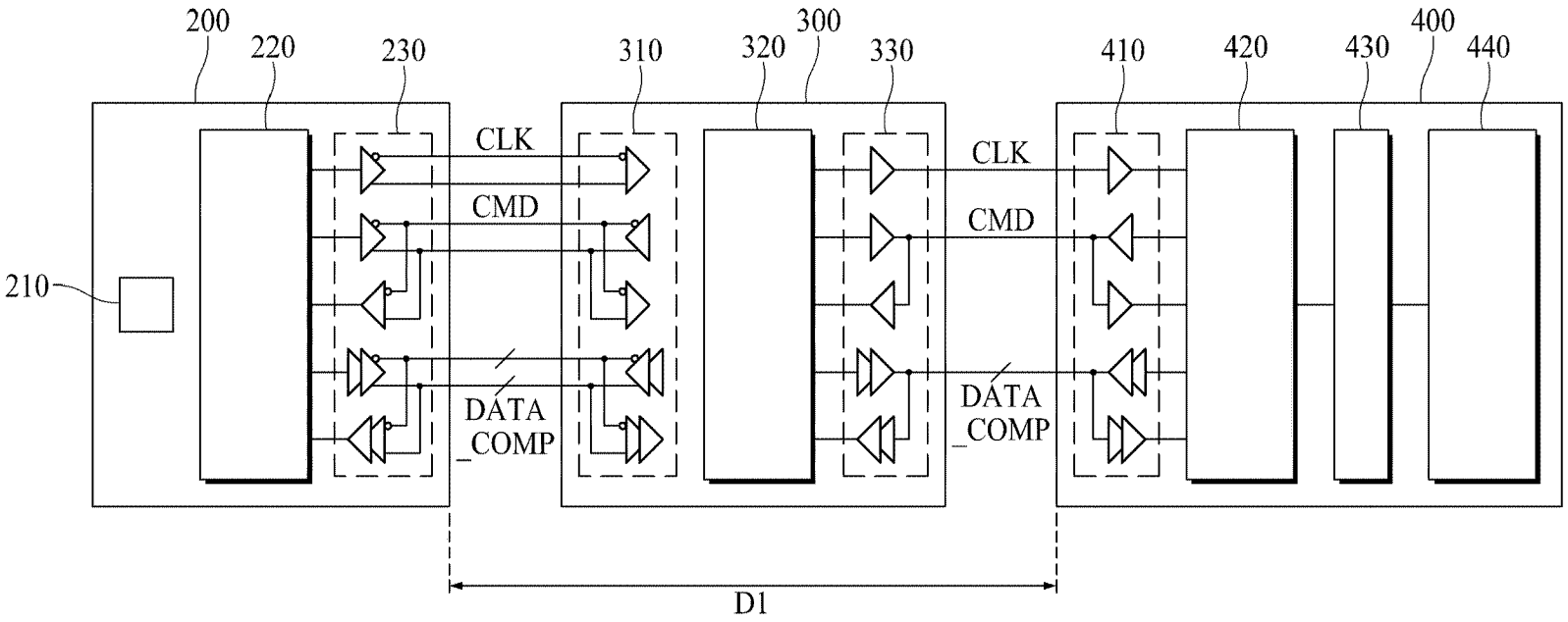
FIG. 7 is a block diagram illustrating a timing controller, a bridge circuit, and a memory of an organic light emitting display device according to the first embodiment of the present disclosure.

FIG. 7 is a block diagram illustrating a timing controller 200, a bridge circuit 300, and a memory 400 of an organic light emitting display device according to the first embodiment of the present disclosure.

The timing controller 200 includes a counter 210, a host controller 220, and a first input and output unit 230.

The counter 210 generates a clock CLK generated inside the timing controller 200. To generate the clock CLK, the counter 210 may built an oscillator therein, which is made of liquid crystal or crystal. An example of the clock CLK includes a VCO clock. The VCO clock is a reference signal that determines an output timing by means of the timing controller 200 regardless of driving or command of the external host system. For example, if the VCO clock exceeds a predetermined number of counting times, the counter 210 outputs compensation data to update the compensation data stored in the memory 400.

The host controller 220 aligns the clock CLK, the command CMD input from the external host system and the compensation data DATA_COMP to be output in the differential signal mode (LVDS). The host controller 220 uses the LVDS mode as the differential signal mode.

The command CMD includes four types of commands, broadcast (BC), broadcast-response (BCR), read (RD), and write (WR). The broadcast BC is a command transferred from the timing controller 200 to the memory 400 without requesting a response of the memory 400. The broadcast response is a command in which the timing controller 200 transmits a command to the memory 400 and then receives a response to the command from the memory 400. The read is a command in which the timing controller 200 transmits a command to the memory 400 and then receives a response from the memory 400 and receives the compensation data DATA_COMP stored in the memory 400. The write is a command in which the timing controller 200 transfers a command to the memory 400 and then receives a response from the memory 400 and updates new compensation data DATA_COMP in the memory 400.

Also, the command CMD according to the present disclosure may include a reset signal RESET which is a signal commanding the memory 400 to reset the compensation data DATA_COMP stored in the memory 400.

The first input and output unit 230 outputs a clock CLK, a command CMD and compensation data DATA_COMP in the LVDS mode.

A logic circuit for outputting the clock CLK from the first input and output unit 230 is realized to only output a signal. Therefore, the clock CLK is only output from the first input and output unit 230, and is not input to the first input and output unit 230.

A logic circuit for outputting the command CMD and the compensation data DATA_COMP from the first input and output unit 230 is realized to enable both input and output of a signal. Therefore, the command CMD and the compensation data DATA_COMP may be output from the first input and output unit 230, or may be input to the first input and output unit 230.

Input and output of the compensation data DATA_COMP to and from the first input and output unit 230 are performed using a plurality of logic circuit pairs. If capacity of the compensation data DATA_COMP is great, the compensation data DATA_COMP may be input and output using the plurality of logic circuit pairs at the same time.

Selectively, the first input and output unit 230 may output the command CMD, which includes a reset signal RESET, if necessary.

The bridge circuit 300 includes a second input and output circuit 310, a bridge controller 320, and a third input and output unit 330.

The second input and output unit 310 receives a clock CLK, a command CMD, and compensation data COMP in an LVDS mode.

A logic circuit for outputting the clock CLK from the second input and output unit 310 is realized to only receive a signal. Therefore, the clock CLK is only input to the second input and output unit 310, and is not output from the second input and output unit 230.

A logic circuit for receiving the command CMD and the compensation data DATA_COMP from the second input and output unit 310 is realized to enable both input and output of a signal. Therefore, the command CMD and the compensation data DATA_COMP may be output from the second input and output unit 310, or may be input to the second input and output unit 310.

Input and output of the compensation data DATA_COMP to and from the second input and output unit 310 are performed using a plurality of logic circuit pairs. If capacity of the compensation data DATA_COMP is great, the compensation data DATA_COMP may be input and output using the plurality of logic circuit pairs at the same time.

Selectively, the second input and output unit 310 may output the command CMD, which includes a reset signal RESET, if necessary.

The bridge controller 320 is aligned to output the clock CLK, the command CMD and the compensation data DATA_COMP, which are received from the second input and output unit 310 in the LVDS mode, in the single-ended signal modes JEDEC1 and JEDEC2. The bridge controller 320 uses the JEDEC standard protocol mode as the single-ended signal modes JEDEC1 and JEDCC2.

The third input and output unit 330 outputs the clock CLK, the command CMD and the compensation data DATA_COMP to the memory 400 in the JEDEC standard protocol mode.

A logic circuit for outputting the clock CLK from the third input and output unit 330 is realized to only output a signal. Therefore, the clock CLK is only output from the third input and output unit 330, and is not input to the third input and output unit 330.

A logic circuit for receiving the command CMD and the compensation data DATA_COMP from the third input and output unit 330 is realized to enable both input and output of a signal. Therefore, the command CMD and the compensation data DATA_COMP may be output from the third input and output unit 330, or may be input to the third input and output unit 330.

Input and output of the compensation data DATA_COMP to and from the third input and output unit 330 are performed using a plurality of logic circuit pairs. If capacity of the compensation data DATA_COMP is great, the compensation data DATA_COMP may be input and output using the plurality of logic circuit pairs at the same time.

Selectively, the third input and output unit 330 may output the command CMD, which includes a reset signal RESET, if necessary.

The memory 400 includes a fourth input and output unit 410, a sorting unit 420, a short term storage unit 430, and a long term storage unit 440. The memory 400 is non-volatile. The memory 400 may be realized as an embedded multimedia card (eMMC).

The fourth input and output unit 410 receives a clock CLK, a command CMD, and compensation data DATA_COMP in a JEDEC standard protocol mode.

A logic circuit for outputting the clock CLK from the fourth input and output unit 410 is realized to only receive a signal. Therefore, the clock CLK is only input to the fourth input and output unit 410, and is not output from the fourth input and output unit 410.

A logic circuit for receiving the command CMD and the compensation data DATA_COMP from the fourth input and output unit 410 is realized to enable both input and output of a signal. Therefore, the command CMD and the compensation data DATA_COMP may be output from the fourth input and output unit 410, or may be input to the fourth input and output unit 410.

Input and output of the compensation data DATA_COMP to and from the fourth input and output unit 410 are performed using a plurality of logic circuit pairs. If capacity of the compensation data DATA_COMP is great, the compensation data DATA_COMP may be input and output using the plurality of logic circuit pairs at the same time.

Selectively, the fourth input and output unit 410 may output the command CMD, which includes a reset signal RESET, if necessary. The memory 400 resets the compensation data DATA_COMP stored therein if the command CMD, which includes a reset signal RESET, is received.

The sorting unit 420 sorts the clock CLK, the command CMD and the compensation data DATA_COMP, which are received from the fourth input and output unit 410, per type.

The sorting unit 420 sorts the command CMD, which needs a response to the timing controller, among the commands CMD. The sorting unit 420 generates the response signal RSP for responding to the command CMD which needs a response. The sorting unit 420 transfers the generated response signal to the fourth input and output unit 410.

The sorting unit 420 may transfer the received compensation data DATA_COMP to the short term storage unit 430. The sorting unit 430 may transfer the compensation data DATA_COMP stored in the short term storage unit 430 to the fourth input and output unit 410.

The short term storage unit 430 receives the transferred compensation data DATA_COMP from the sorting unit 420. The short term storage unit 430 may transfer the compensation data DATA_COMP to the long term storage unit 440. The short term storage unit 430 may transfer the compensation data DATA_COMP stored therein to the sorting unit 420. The short term storage unit 430 may transfer the compensation data DATA_COMP to the sorting unit 420 by loading the compensation data DATA_COMP stored in the long term storage unit 440 if necessary.

The long term storage unit 440 receives the compensation data DATA_COMP transferred from the short term storage unit 430. The long term storage unit 440 may transfer the compensation data DATA_COMP stored therein to the short term storage unit 430. The long term storage unit 440 may be realized as a non-volatile memory.

According to the first embodiment of the present disclosure, a length of the connection line or cable between the timing controller 200 and the memory 400 may be set to a first distance D1. The first distance D1 may be 1 m to 10 m. This length is significantly increased more than 40 mm to 60 mm. According to the first embodiment of the present disclosure, the bridge circuit 300 for transferring a signal in the LVDS mode may be added between the timing controller 200 and the memory 400, whereby the length of the first length D1 may be increased significantly.

Figure 8:
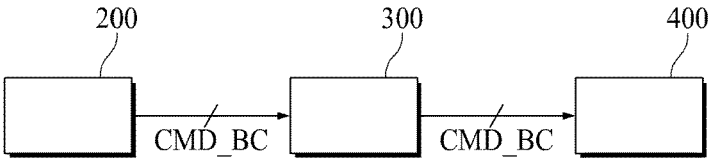
FIG. 8 is a block diagram illustrating a broadcast command of an organic light emitting display device according to the present disclosure.

FIG. 8 is a block diagram illustrating a broadcast command CMD_BC of an organic light emitting display device according to the present disclosure.

The timing controller 200 outputs a broadcast command CMD_BC to the bridge circuit 300. The bridge circuit 300 outputs the broadcast command CMD_BC to the memory 400.

Figure 9:
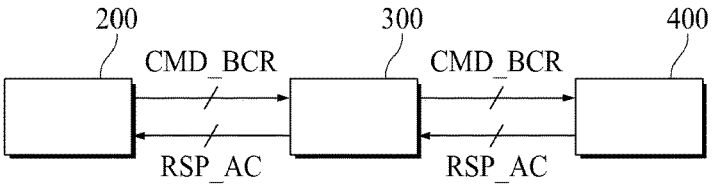
FIG. 9 is a block diagram illustrating a broadcast response command of an organic light emitting display device according to the present disclosure.

FIG. 9 is a block diagram illustrating a broadcast response command CMD_BCR of an organic light emitting display device according to the present disclosure.

The timing controller 200 outputs a broadcast response command CMD_BCR to the bridge circuit 300. The bridge circuit 300 outputs the broadcast response command CMD_BCR to the memory 400.

The memory 400 generates an acknowledgement response signal RSP_AC for allowing the timing controller 200 to acknowledge that the broadcast response command CMD_BCR has been received. The memory 400 outputs the acknowledgement response signal RSP_AC to the bridge circuit 300. The bridge circuit 300 outputs the acknowledgement response signal RSP_AC to the timing controller 200.

Figure 10:
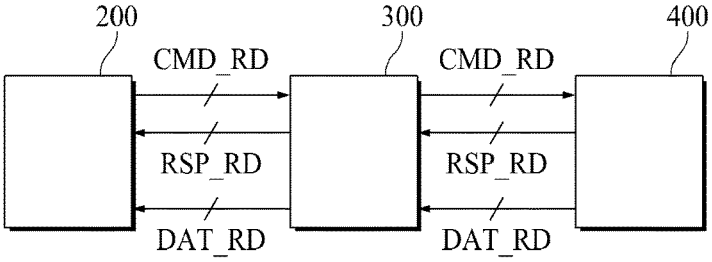
FIG. 10 is a block diagram illustrating a read command of an organic light emitting display device according to the present disclosure.

FIG. 10 is a block diagram illustrating a read command CMD_RD of an organic light emitting display device according to the present disclosure.

The timing controller 200 outputs the read command CMD_RD to the bridge circuit 300. The bridge circuit 300 outputs the read command CMD_RD to the memory 400.

The memory 400 generates a read response signal RSP_RD for notifying the timing controller 200 that the read command CMD_RD has been received. The memory 400 outputs the read response signal RSP_RD to the bridge circuit 300. The bridge circuit 300 outputs the read response signal RSP_RD to the timing controller 200.

The memory 400 allows the timing controller 200 to read the compensation data DATA_COMP which is previously stored therein. The memory 400 outputs the read data DATA_RD, which are the previously stored compensation data, to the bridge circuit 300. The bridge circuit 300 outputs the read data DATA_RD to the timing controller 200. The bridge circuit 300 outputs the read data DATA_RD to the timing controller 200.

Figure 11:
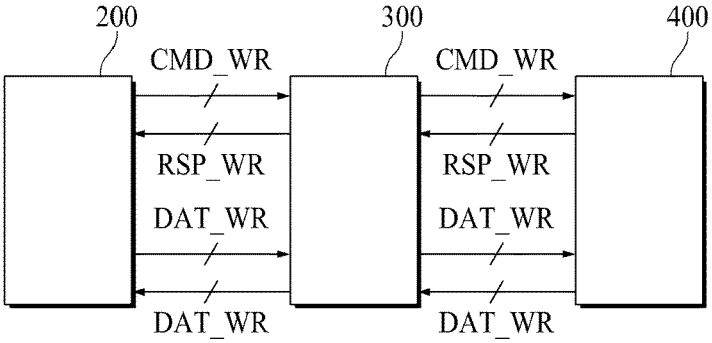
FIG. 11 is a block diagram illustrating a write command of an organic light emitting display device according to the present disclosure.

FIG. 11 is a block diagram illustrating a write command CMD_WR of an organic light emitting display device according to the present disclosure.

The timing controller 200 outputs the write command CMD_WR to the bridge circuit 300. The bridge circuit 300 outputs the write command CMD_WR to the memory 400.

The memory 400 generates a write response signal RSP_WR for notifying the timing controller 200 that the write command CMD_WR has been received. The memory 400 outputs the write response signal RSP_WR to the bridge circuit 300. The bridge circuit 300 outputs the write response signal RSP_WR to the timing controller 200.

The timing controller 200 receives the write response signal RSP_WR and outputs write data DATA_WR, which are new compensation data, to the bridge circuit 300. The bridge circuit 300 outputs the write data DATA_WR to the memory 400.

Selectively, the memory 400 may again output the write data DATA_WR to the bridge circuit 300 to acknowledge whether the compensation data written by the timing controller 200 are normal. The bridge circuit 300 may output the write data DATA_WR to the timing controller 200.

Figure 12:
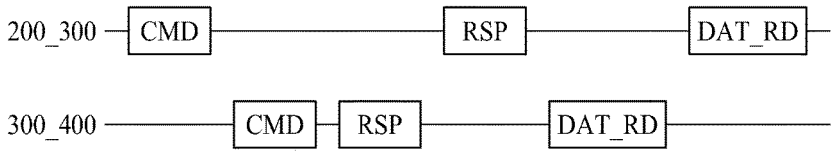
FIG. 12 is a timing flow chart illustrating a read command of an organic light emitting display device according to the present disclosure.

FIG. 12 is a timing flow chart illustrating a read command CMD_RD of an organic light emitting display device according to the present disclosure.

Firstly, the command CMD is transferred from the timing controller 200 to the bridge circuit 300. The command CMD includes a content for loading read data DATA_RD for reading among the compensation data DATA_COMP stored in the memory 400.

Secondly, the command CMD is transferred from the bridge circuit 300 to the memory 400.

Thirdly, the response signal RSP is transferred from the memory 400 to the bridge circuit 300. The response signal RSP includes a notification for acknowledging that the command CMD of the timing controller 200 has been received and outputting the read data DATA_RD of the stored compensation data DATA_COMP.

Fourthly, the response signal RSP is transferred from the bridge circuit 300 to the timing controller 200.

Fifthly, the read data DATA_RD are transferred from the memory 400 to the bridge circuit 300.

Sixthly, the read data DATA_RD are transferred from the bridge circuit 300 to the timing controller 200.

Figure 13:
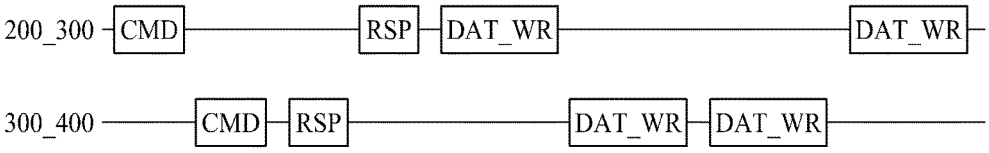
FIG. 13 is a timing flow chart illustrating a write command of an organic light emitting display device according to the present disclosure.

FIG. 13 is a timing flow chart illustrating a write command CMD_WR of an organic light emitting display device according to the present disclosure.

Firstly, the command CMD is transferred from the timing controller 200 to the bridge circuit 300. The command CMD includes a content for writing write data DATA_WR, which are new compensation data DATA_COMP, in the memory 400.

Secondly, the command CMD is transferred from the bridge circuit 300 to the memory 400.

Thirdly, the response signal RSP is transferred from the memory 400 to the bridge circuit 300. The response signal RSP includes a notification for acknowledging that the command CMD of the timing controller 200 has been received and indicating that the write data DATA_WR are ready to be written.

Fourthly, the response signal RSP is transferred from the bridge circuit 300 to the timing controller 200.

Fifthly, the write data DATA_WR are transferred from the timing controller 200 to the bridge circuit 300.

Sixthly, the write data DATA_WR are transferred from the bridge circuit 300 to the memory 400.

Selectively, the write data DATA_WR may be transferred from the memory 400 to the bridge circuit 300 to acknowledge whether the compensation data for which writing has been performed are normal. The write data DATA_WR may be transferred from the bridge circuit 300 to the timing controller 200.

Figure 14:
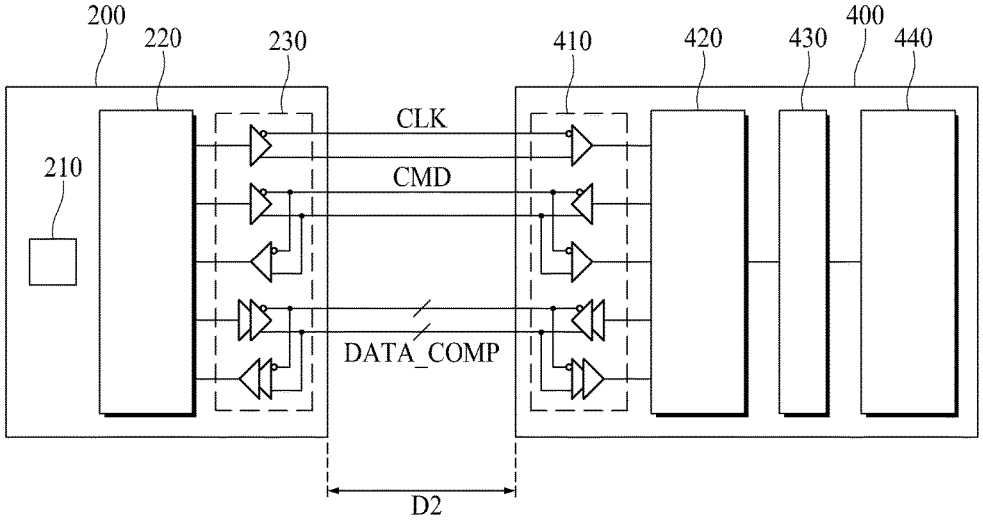
FIG. 14 is a block diagram illustrating a timing controller and a memory of an organic light emitting display device according to the second embodiment of the present disclosure.

FIG. 14 is a block diagram illustrating a timing controller 200 and a memory 400 of an organic light emitting display device according to the second embodiment of the present disclosure.

The timing controller 200 according to the second embodiment of the present disclosure generates compensation data DATA_COMP, which may perform external compensation and blur compensation, by using sensing data SEN. The timing controller 200 outputs the generated compensation data DATA_COMP.

The memory 400 receives the compensation data DATA_COMP from the timing controller 200. The memory 400 is packaged in the source printed circuit board 150.

The timing controller 200 and the memory 400 are connected with each other by a plurality of lines for bidirectionally transferring a clock CLK generated within the timing controller 200, a command CMD input from an external host system and compensation data DATA_COMP in accordance with an LVDS mode of a differential signal mode.

The timing controller 200 and the memory 400 include an input and output unit for inputting and outputting the clock CLK, the command CMD and the compensation data DATA_COMP in an LVDS mode.

The timing controller 200 includes a counter 210, a host controller 220, and a first input and output unit 230.

The counter 210 generates a clock CLK generated inside the timing controller 200. To generate the clock CLK, the counter 210 may built an oscillator therein, which is made of liquid crystal or crystal. An example of the clock CLK includes a VCO clock. The VCO clock is a reference signal that determines an output timing by means of the timing controller 200 regardless of driving or command of the external host system. For example, if the VCO clock exceeds a predetermined number of counting times, the counter 210 outputs compensation data to update the compensation data stored in the memory 400.

The host controller 220 aligns the clock CLK, the command CMD input from the external host system and the compensation data DATA_COMP to be output in the differential signal mode (LVDS). The host controller 220 uses the LVDS mode as the differential signal mode.

The command CMD includes four types of commands, broadcast (BC), broadcast-response (BCR), read (RD), and write (WR). The broadcast BC is a command transferred from the timing controller 200 to the memory 400 without requesting a response of the memory 400. The broadcast response is a command in which the timing controller 200 transfers a command to the memory 400 and then receives a response to the command from the memory 400. The read is a command in which the timing controller 200 transfers a command to the memory 400 and then receives a response from the memory 400 and receives the compensation data DATA_COMP stored in the memory 400. The write is a command in which the timing controller 200 transfers a command to the memory 400 and then receives a response from the memory 400 and updates new compensation data DATA_COMP in the memory 400.

Also, the command CMD according to the present disclosure may include a reset signal RESET which is a signal commanding the memory 400 to reset the compensation data DATA_COMP stored in the memory 400.

The first input and output unit 230 outputs a clock CLK, a command CMD and compensation data DATA_COMP in the LVDS mode.

A logic circuit for outputting the clock CLK from the first input and output unit 230 is realized to only output a signal. Therefore, the clock CLK is only output from the first input and output unit 230, and is not input to the first input and output unit 230.

A logic circuit for outputting the command CMD and the compensation data DATA_COMP from the first input and output unit 230 is realized to enable both input and output of a signal. Therefore, the command CMD and the compensation data DATA_COMP may be output from the first input and output unit 230, or may be input to the first input and output unit 230.

Input and output of the compensation data DATA_COMP to and from the first input and output unit 230 are performed using a plurality of logic circuit pairs. If capacity of the compensation data DATA_COMP is great, the compensation data DATA_COMP may be input and output using the plurality of logic circuit pairs at the same time.

Selectively, the first input and output unit 230 may output the command CMD, which includes a reset signal RESET, if necessary.

The memory 400 includes a fourth input and output unit 410, a sorting unit 420, a short term storage unit 430, and a long term storage unit 440.

The fourth input and output unit 410 receives a clock CLK, a command CMD, and compensation data COMP in an LVDS mode.

A logic circuit for outputting the clock CLK from the fourth input and output unit 410 is realized to only receive a signal. Therefore, the clock CLK is only input to the fourth input and output unit 410, and is not output from the fourth input and output unit 410.

A logic circuit for receiving the command CMD and the compensation data DATA_COMP from the fourth input and output unit 410 is realized to enable both input and output of a signal. Therefore, the command CMD and the compensation data DATA_COMP may be output from the fourth input and output unit 410, or may be input to the fourth input and output unit 410.

Input and output of the compensation data DATA_COMP to and from the fourth input and output unit 410 are performed using a plurality of logic circuit pairs. If capacity of the compensation data DATA_COMP is great, the compensation data DATA_COMP may be input and output using the plurality of logic circuit pairs at the same time.

Selectively, the fourth input and output unit 410 may receive the command CMD, which includes a reset signal RESET, if necessary. The memory 400 resets the compensation data DATA_COMP stored therein if the command CMD, which includes a reset signal RESET, is received.

The sorting unit 420 sorts the clock CLK, the command CMD and the compensation data DATA_COMP, which are received from the fourth input and output unit 410, per type.

The sorting unit 420 sorts the command CMD, which needs a response to the timing controller, among the commands CMD. The sorting unit 420 generates the response signal RSP for responding to the command CMD which needs a response. The sorting unit 420 transfers the generated response signal to the fourth input and output unit 410.

The sorting unit 420 may transfer the received compensation data DATA_COMP to the short term storage unit 430. The sorting unit 430 may transfer the compensation data DATA_COMP stored in the short term storage unit 430 to the fourth input and output unit 410.

The short term storage unit 430 receives the transferred compensation data DATA_COMP from the sorting unit 420. The short term storage unit 430 may transfer the compensation data DATA_COMP to the long term storage unit 440. The short term storage unit 430 may transfer the compensation data DATA_COMP stored therein to the sorting unit 420. The short term storage unit 430 may transfer the compensation data DATA_COMP to the sorting unit 420 by loading the compensation data DATA_COMP stored in the long term storage unit 440 if necessary.

The long term storage unit 440 receives the compensation data DATA_COMP transferred from the short term storage unit 430. The long term storage unit 440 may transfer the compensation data DATA_COMP stored therein to the short term storage unit 430. The long term storage unit 440 may be realized as a non-volatile memory.

According to the second embodiment of the present disclosure, a length of the connection line or cable between the timing controller 200 and the memory 400 may be set to a second distance D2. The second distance D2 may be 1 m to 10 m. This length is increased more remarkably than 40 mm to 60 mm. According to the second embodiment of the present disclosure, a signal transfer mode between the timing controller 200 and the memory 400 is set to the LVDS mode. Therefore, the length of the second distance D2 may be increased more remarkably than that used in case of the existing single-ended signal mode.

The organic light emitting display device according to the present disclosure mitigates a connection restriction between the timing controller and the memory by using the bridge circuit. If the connection restriction between the timing controller and the memory is mitigated, it is not required to design that the timing controller and the memory are close to each other. If the distance between the timing controller and the memory is increased, the memory may be arranged on the source printed circuit board. If the memory is arranged on the source printed circuit board, the display panel or the printed circuit board may be exchanged or processed separately. Therefore, the organic light emitting display device according to the present disclosure may be applied to a plurality of display panels without writing of the compensation data, thereby providing the control printed circuit board of which general use is excellent.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device comprising:

a display panel on which organic light emitting diodes and driving transistors that drive the organic light emitting diodes are arranged;

a data driver that generates sensing data based on respective threshold voltages of the driving transistors and respective degradation levels of the organic light emitting diodes;

a timing controller that generates compensation data, which may be used to perform external compensation and blur compensation, based on the sensing data and outputs the compensation data;

a bridge circuit that receives the compensation data from the timing controller; and a memory that receives the compensation data from the bridge circuit, wherein the bridge circuit and the memory are packaged in a source printed circuit board, and the bridge circuit receives a clock generated within the timing controller, a command input from an external host system, and the compensation data in a differential signal mode.

2. The organic light emitting display device of claim 1, wherein the timing controller is configured to generate compensation digital video data by performing the external compensation and the blur compensation based on the compensation data, and to output the compensation digital video data to the data driver.

3. The organic light emitting display device of claim 1, wherein the bridge circuit supplies the clock, the command and the compensation data to the memory in a single-ended signal mode.

4. The organic light emitting display device of claim 1, wherein a signal transmission distance between the timing controller and the memory is within a range from 1 m to 10 m.

5. The organic light emitting display device of claim 1, wherein the timing controller includes a first input and output unit that outputs the clock, the command and the compensation data in a low voltage differential signal (LVDS) mode of the differential signal mode.

6. The organic light emitting display device of claim 5, wherein the bridge circuit includes a second input and output unit that receives the clock, the command and the compensation data in the LVDS mode, and a third input and output unit that outputs the clock, the command and the compensation data to the memory in a JEDEC standard protocol mode of the single-ended signal mode.

7. The organic light emitting display device of claim 6, wherein the memory is a non-volatile embedded multimedia card, and includes a fourth input and output unit that receives the clock, the command and the compensation data in the JEDEC standard protocol mode.

8. The organic light emitting display device of claim 1, wherein the memory outputs a response signal to the command in a single-ended signal mode, and the bridge circuit outputs the response signal to the timing controller in the differential signal mode.

9. The organic light emitting display device of claim 8, wherein the memory supplies the compensation data stored therein to the bridge circuit in the single-ended signal mode in response to the command, and the bridge circuit supplies the compensation data to the timing controller in the differential signal mode.

10. The organic light emitting display device of claim 8, wherein the timing controller supplies new compensation data to the bridge circuit in the differential signal mode in response to the response signal, and the bridge circuit supplies the new compensation data to the memory in the single-ended signal mode.

11. An organic light emitting display device comprising:

a display panel on which organic light emitting diodes and driving transistors configured to drive the organic light emitting diodes are arranged;

a data driver configured to generate sensing data based on respective threshold voltages of the driving transistors and respective degradation levels of the organic light emitting diodes;

a timing controller configured to generate compensation data, which may be used to perform external compensation and blur compensation, based on the sensing data, and output the compensation data; and a memory configured to receive the compensation data from the timing controller, wherein the memory is packaged in a source printed circuit board, and the timing controller and the memory are connected with each other by a plurality of lines for bi-directionally transferring a clock generated within the timing controller, a command input from an external host system, and the compensation data in accordance with a low voltage differential signal (LVDS) mode of a differential signal mode, and the timing controller and the memory include an input and output unit for inputting and outputting the clock, the command and the compensation data in the LVDS mode.

* * * * *